US009349550B2

(12) United States Patent
Benni et al.

(10) Patent No.: US 9,349,550 B2
(45) Date of Patent: May 24, 2016

(54) EMERGENCY STOP DEVICE ADAPTABLE FOR A MAN-MACHINE DIALOG SYSTEM

(75) Inventors: Dominique Benni, Mornac (FR); Alain Tardivon, Gourville (FR); Francis Chauvet, Mouthiers (FR); Eric Lemasson, Anisy (FR)

(73) Assignee: SCHNEIDER ELECTRIC INDUSTRIES SAS, Rueil-Malmaison (FR)

( * ) Notice: Subject to any disclaimer, the term of this patent is extended or adjusted under 35 U.S.C. 154(b) by 101 days.

(21) Appl. No.: 14/239,420

(22) PCT Filed: Aug. 3, 2012

(86) PCT No.: PCT/EP2012/065280

§ 371 (c)(1), (2), (4) Date: Feb. 18, 2014

(87) PCT Pub. No.: WO2013/034379

PCT Pub. Date: Mar. 14, 2013

(65) Prior Publication Data

US 2014/0216911 A1 Aug. 7, 2014

(30) Foreign Application Priority Data

Sep. 7, 2011 (FR) ..... 11 57926

(51) Int. Cl.

| | |
|---|---|
| ***H01H 1/14*** | (2006.01) |
| ***H01H 13/14*** | (2006.01) |
| ***H01H 13/62*** | (2006.01) |
| ***H01H 3/02*** | (2006.01) |
| *H01H 9/16* | (2006.01) |
| *H01H 13/02* | (2006.01) |

(52) U.S. Cl.

CPC ..... *H01H 13/62* (2013.01); *H01H 3/022* (2013.01); *H01H 9/161* (2013.01); *H01H 13/023* (2013.01); *H01H 2003/0246* (2013.01)

(58) Field of Classification Search

CPC ..... H01H 13/36; H01H 13/62; H01H 3/022; H01H 13/38; H01H 1/26; H01H 5/18

USPC ..... 200/534, 535

See application file for complete search history.

(56) References Cited

U.S. PATENT DOCUMENTS 4,613,736 A * 9/1986 Shichijo et al. ..... 200/317
5,151,696 A * 9/1992 Kasahara et al. ..... 341/22

(Continued)

FOREIGN PATENT DOCUMENTS

WO 2011 062124 5/2011
WO 2011 073108 6/2011

OTHER PUBLICATIONS

International Search Report Issued Nov. 20, 2012 in PCT/EP12/065280 Filed Aug. 3, 2012.

*Primary Examiner* — Renee Luebke
*Assistant Examiner* — Lheiren Mae A Caroc
(74) *Attorney, Agent, or Firm* — Oblon, McClelland, Maier & Neustadt, L.L.P.

(57) ABSTRACT

An emergency stop device including a body, a control button that is translatably movable along a control axis, at least one set of electric contacts that are normally closed and which include a mobile electric contact and a stationary electric contact, a flexible blade having a first free end and a second free end, and an actuation push member that can be translatably actuated, by the control button, between a rest position and an actuated position, and which is configured to engage with the flexible blade. The flexible blade includes a bearing area for the actuation push member, and the flexible blade is shaped to rigidify the bearing area.

14 Claims, 4 Drawing Sheets

(56) References Cited

U.S. PATENT DOCUMENTS

| | | | | |
|---|---|---|---|---|
| 5,237,883 | A | 8/1993 | Churchill et al. | |
| 5,310,974 | A | 5/1994 | Churchill et al. | |
| 6,281,482 | B1 * | 8/2001 | Chu | 219/507 |
| 2011/0168536 | A1 * | 7/2011 | Chauvet et al. | 200/341 |
| 2012/0228108 | A1 | 9/2012 | Kawaguchi et al. | |
| 2012/0280800 | A1 | 11/2012 | Chauvet et al. | |

* cited by examiner

EMERGENCY STOP DEVICE ADAPTABLE FOR A MAN-MACHINE DIALOG SYSTEM

TECHNICAL FIELD OF THE INVENTION

The present invention relates to an emergency stop device that can be fitted to a human-machine dialog system.

PRIOR ART

In a human-machine dialog system of the type described in patent application WO2011/073108 and which comprises several human-machine dialog devices such as push-buttons, indicator lamps, it is possible also to provide an emergency stop device. In such a system, the emergency stop device needs to have a particularly compact design, notably in the depthwise direction and needs to be of a size equivalent of that of the other human-machine dialog devices used in the system.

Document WO2011/062124 discloses an emergency stop device that uses a flexible strip mechanism to carry the mobile contact. In this solution, if the electrical contacts become welded together, action on the flexible strip causes it to flex. It is therefore difficult, or even impossible, to unweld the contacts.

It is therefore an object of the invention to propose an emergency stop device that is compact enough that it can be used in a human-machine dialog system of the type descried in the aforementioned patent application. Another object of the invention is to propose an emergency stop device of reliable operation in which, in the event of the contacts becoming welded together, it is possible to unweld them easily.

SUMMARY OF THE INVENTION

This object is achieved using an emergency stop device comprising a body, a control button movable in translation along a control axis, at least one set of electrical contacts of the normally closed type comprising a mobile electrical contact and a fixed electrical contact, a flexible strip comprising a fixed first end and a free second end and an actuating press rod that can be actuated in translation by said control button between a rest position and an actuated position and able to collaborate with the flexible strip, said actuating press rod comprising an actuating tab arranged so as to apply a movement force to the flexible strip, said movement force being applied in an actuating plane, the flexible strip comprising:

- a first portion connected to the fixed first end,
- a second portion connected to the first portion and produced in a plane situated in the actuating plane,
- a third portion connected to the second portion and carrying the mobile electrical contact.

For preference, the first portion is connected to the second portion by a first bend, the second portion is connected to the third portion by a second bend, the flexible strip comprises a rib made on the first bend and a rib made on the second bend.

For preference, the first portion is straight in shape.

According to the invention, the use of a single flexible strip notably allows the device to meet the compactness requirement. However, this use introduces certain restrictions because the flexible strip does, after all, need to be able to withstand significant mechanical force if the contacts need to be unwelded. In the area in which the unwelding load is applied, the flexible strip has therefore to be stiff enough that it does not flex.

According to one particular feature, the device comprises a contact pressure spring positioned between the flexible strip and the body.

According to another particular feature, the device comprises a printed circuit on which the fixed electrical contact is produced.

According to another particular feature, the device comprises an opening spring arranged between the control button and the actuating press rod.

According to another particular feature, the device comprises a tripping device collaborating with the actuating press rod and with the body and comprising a position of abutment in which it keeps the actuating press rod in its rest position and an actuated position in which it releases the actuating press rod under the action of the opening spring.

According to another particular feature, the control button is able to move between two extreme positions, a rest position and an actuated position in which the control button comes to rest against a fixed end stop of the body.

According to another particular feature, the device comprises a lighting assembly assembled with the printed circuit.

According to another particular feature, the device comprises a guide rod oriented along the control axis and passing through the printed circuit and the actuating device and that becomes inserted in an axial housing of the control button.

The invention also relates to a human-machine dialog system which comprises:

- a first part including a data processing unit and an electrical power supply unit,
- a second part comprising several human-machine dialog devices each provided with a human-machine dialog interface and a fixing support designed to accept each human-machine dialog device in a removable and interchangeable manner,
- communication and power supply means arranged between the first part and each human-machine dialog device,
- at least one of the several human-machine dialog devices consisting of an emergency stop device as described hereinabove.

BRIEF DESCRIPTION OF THE FIGURES

Other features and advantages will become apparent from the detailed description which follows with reference to the appended drawings in which.

DETAILED DESCRIPTION OF AT LEAST ONE EMBODIMENT

In the known way, an emergency stop device is intended to control an electrical circuit and can be actuated by an operator in order to break the electrical circuit in an emergency.

Figure 1:
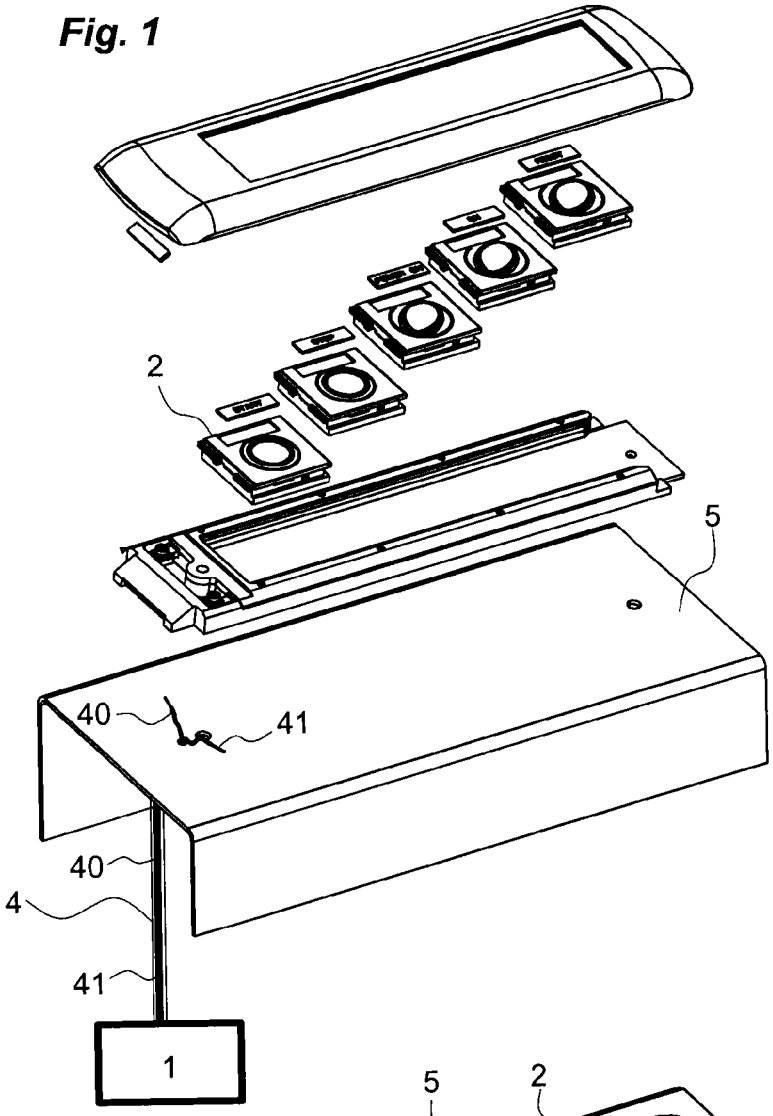
FIG. 1 depicts, in exploded view, a human-machine dialog system able to accommodate the emergency stop device of the invention.
Figure 2:
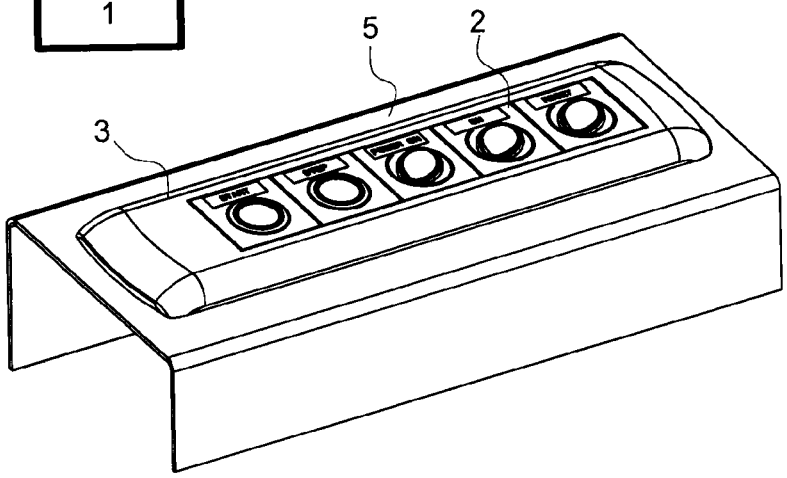
FIG. 2 depicts, in an assembled view, the human-machine dialog system of FIG. 1.
Figure 3:
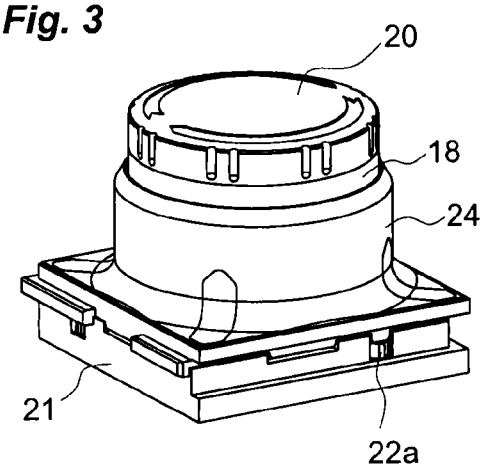
FIG. 3 depicts the emergency stop device of the invention.
Figure 4:
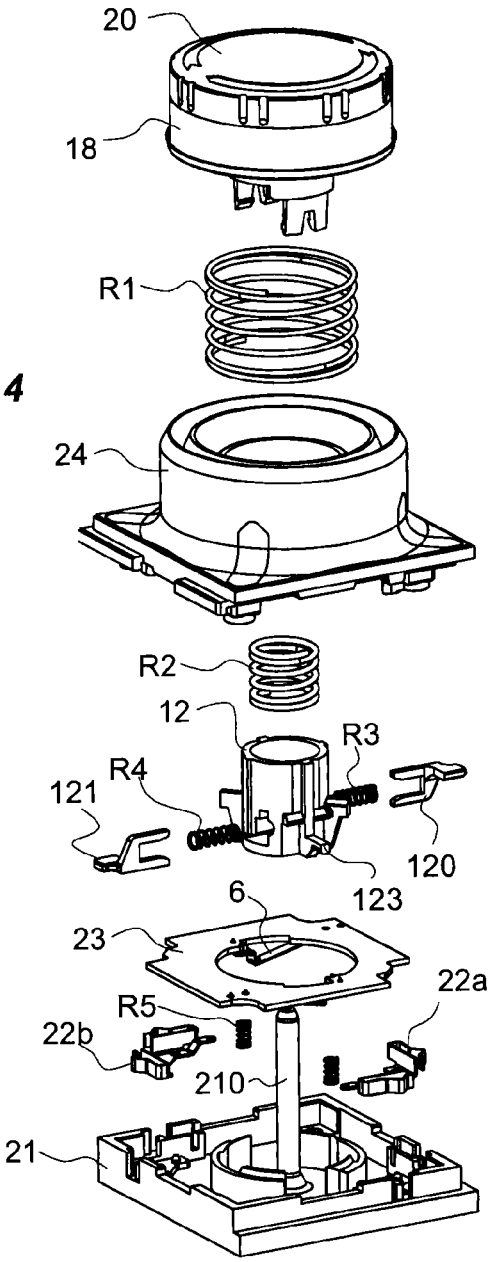
FIG. 4 depicts, in exploded view, the emergency stop device of the invention.

The emergency stop device of the invention is designed to be used in a human-machine dialog system of the kind depicted in FIGS. 1 and 2. This human-machine dialog system is intended to accept several human-machine dialog devices on one and the same support. One of the human-machine dialog devices is, for example, the emergency stop device of the invention.

More specifically, the human-machine dialog system comprises a first part 1 comprising a data reading/writing station and a second part comprising the human-machine dialog devices 2 each provided with a human-machine dialog interface, with processing means, and, for example, with a memory.

The first part 1 and the second part are connected to one another by wired or wireless communication means. In FIG. 1, they are connected together using a communication and power supply bus 4 that provides communication between the reading/writing station and each human-machine dialog device 2 and provides power between the reading/writing station and the human-machine dialog devices 2. This communication and power supply bus 4 is, for example, produced on two distinct conducting lines, a first conducting line 40 connected to a non-zero electrical potential and transmitting both the current that powers the human-machine dialog devices 2 and the communication frames exchanged between the reading/writing station and the human-machine dialog devices 2, and a second conducting line 41 at a neutral electrical potential.

The reading/writing station and the various human-machine dialog devices 2 exchange data on the communication and power supply bus 4, using a simple communications protocol.

As an alternative form of embodiment, the communication means may be wireless, for example using wireless interfaces operating by RFID.

According to the invention, the second part of the system comprises a fixing support 3 capable of accepting, removably and interchangeably, one or more human-machine dialog devices 2 of the type described hereinabove. The fixing support 3 comprises for example two parallel conducting rails extending the two conducting lines 40, 41 and to which each human-machine dialog device 2 can be connected.

The human-machine dialog system is therefore produced by connecting the first part 1 to the second part with the communication and power supply bus 4. This system is particularly well suited to being positioned on the door of an enclosure or on a control desk. The system of the invention can thus replace buttons or indicators each individually fixing supported on the door of the enclosure or on the control desk. In the appended figures, the door of the enclosure or the control desk are depicted in the form of a simple wall 5.

As depicted in FIGS. 3 to 8, the emergency stop device intended to be used as a human-machine dialog device in a system as described hereinabove is made up of a casing 21 of square shape, of at least two electrical contacts 22*a*, 22*b* produced on the outside of the casing 21, of a printed circuit 23 fixing supported inside the casing, of a façade 24 that closes the casing and of a mobile control button 20 fixing supported on the façade and able to move along a control axis (X). It may comprise processing means, such as a microprocessor, and a memory intended to store data indicative of its status. The processing means and the memory are assembled with the printed circuit 23 and connected to the electrical contacts 22*a*, 22*b* produced on the casing 21, said electrical contacts 22*a*, 22*b* being intended to be connected to the communication and power supply bus 4 when the device is inserted in the fixing support 3 of the system.

The façade 24 comprises a body provided with a central opening and formed of a cylindrical collar 240 produced around the periphery of the central opening, of an internal cylindrical sleeve 241 and of a cup 242 defined between the collar 240 and the sleeve 241.

The device comprises a return spring R1 of the helical type housed in the cup 242 and urged along the control axis (X) by the control button 20. The control button 20 is initially in a rest position (FIGS. 5 and 7) in which the controlled electrical circuit is closed. By being pressed toward the inside of the device, the control button 20 can be brought into a position of abutment against the body of the façade 24, thus allowing the electrical circuit to be positively opened. Following actuation, the control button 20 is released but remains caught in an actuated position (FIGS. 6 and 8) in which the electrical circuit is open. The electrical circuit remains open until the device is unlocked.

Figure 5:
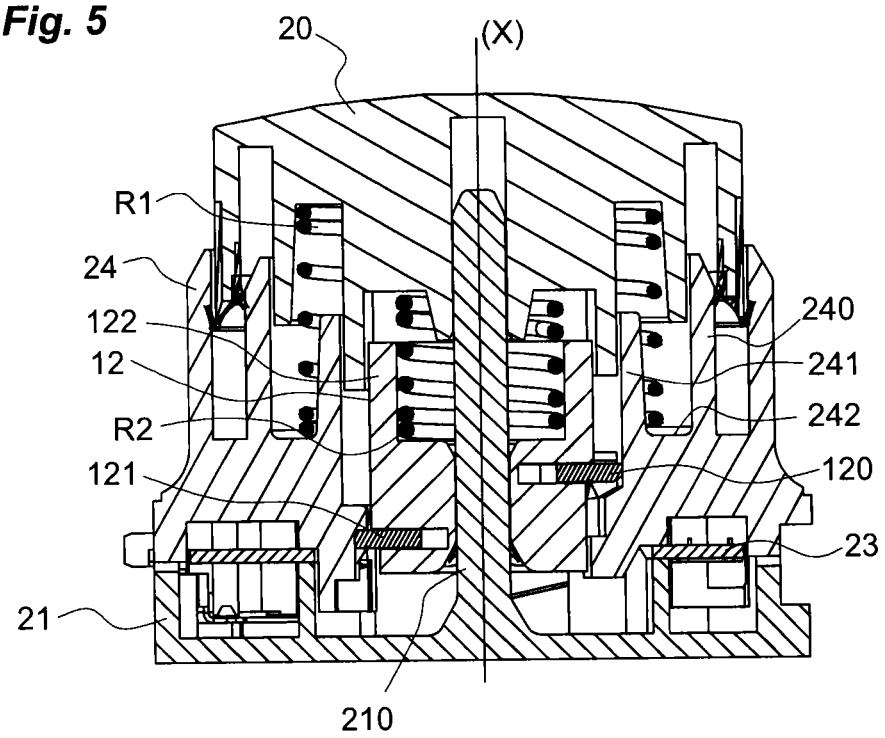
FIGS. 5 and 6 depict, viewed in a first axial section, the emergency stop device of the invention in which the control button respectively has the rest status and the actuated status.
Figure 6:
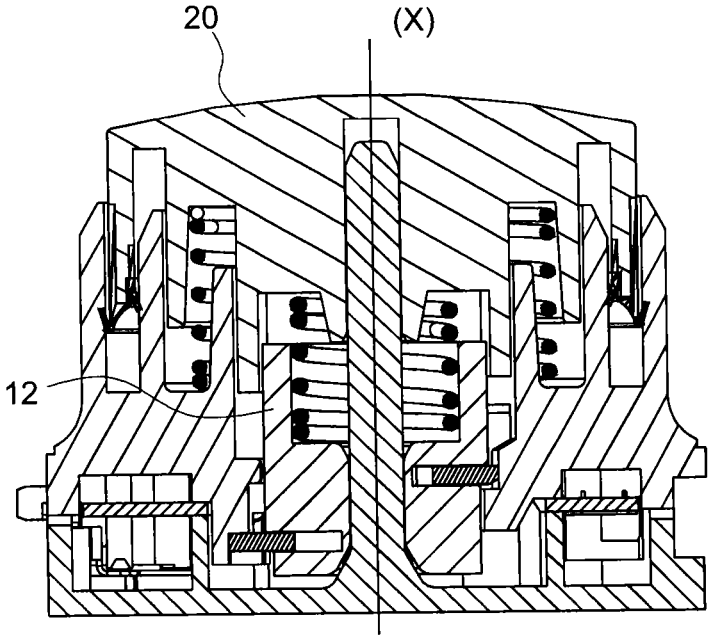
Figure 7:
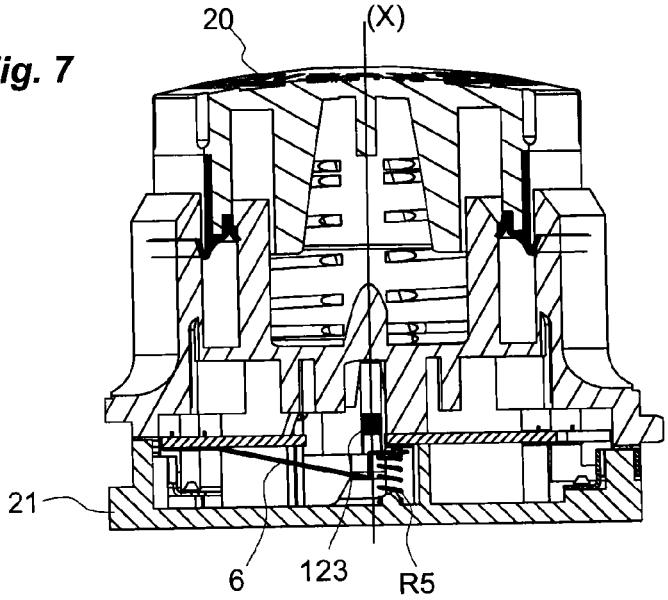
FIGS. 7 and 8 depict, viewed in a second axial section, the emergency stop device of the invention in which the control button respectively has the rest status and the actuated status.
Figure 8:
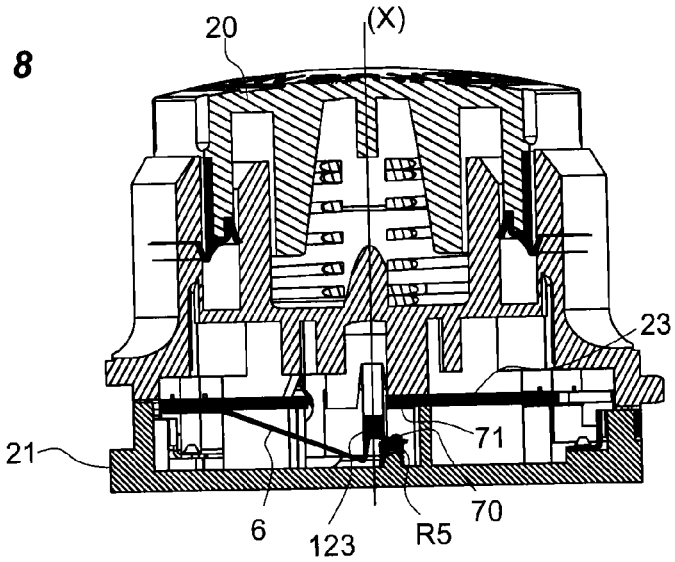

The emergency stop device of the invention also comprises an actuating press rod 12 attached to the control button 20 by fixing devices produced on the control button 20. The actuating press rod 12 has a central axial drilling and a collar 122 situated around the periphery of said drilling defining a seat intended to accept an opening spring R2 bearing at one end against the actuating press rod 12 and at the other against the control button 20. The actuating press rod is urged in a translational movement along the control axis by the opening spring R2 against the fixing devices. The control button 20 and the actuating press rod 12 are free in translational movement relative to one another through the compression of the opening spring R2. When the control button 20 is in the rest position, the actuating press rod 12 is in a rest position (FIGS. 5 and 7). When pressure is applied to the control button 20 toward the actuated position thereof, the actuating press rod 12 initially remains in a rest position, causing the opening spring R2 to become compressed in order to store energy. When the opening spring R2 is sufficiently compressed, the actuating press rod 12 is released sharply, driven by the energy stored by the opening spring R2. The actuating press rod 12 is then in the actuated position. After actuation, the actuating press rod 12 remains caught in the actuated position and via the fixing devices keeps the control button 20 in the actuated position toward the inside of the body 10. If the control button 20 is released, it remains in the actuated position. An unlocking then needs to be performed in order to return the control button and the actuating press rod to their rest position.

The emergency stop device also comprises a tripping device 120 and a catching device 121 (FIGS. 2, 5 and 6), for example each one made up of a finger which becomes lodged in a radial housing produced on the actuating press rod 12. Each of these two devices is fixing supported on a helical spring R3, R4 so that it can move radially relative to the control axis (X). The tripping device 120 and the catching device 121 are positioned in such a way that each collaborates with the body of the façade 24 depending on the position of the control button 20. The tripping device 120 and the catching device 121 are able to move in two distinct parallel planes perpendicular to the control axis (X). The plane of translation of the tripping device 120 is situated above the plane of translation of the catching device 121. On the internal surface of its central opening, the body of the façade has cam shapes intended to be followed by the tripping device 120 and the catching device 121, allowing each of these devices to perform their function. The tripping device 120 collaborates with the body of the façade to keep the actuating press rod 12 in the rest position until sufficient energy has been stored in the opening spring R2. When the control button 20 is depressed far enough, under the action of a cam shape produced on the body of the façade 24, the tripping device 120 retracts into its housing to release the actuating press rod 12 under the action of the opening spring R2. The actuating press rod 12 therefore also keeps the control button 20 in its actuated position toward the inside of the body. The catching device 121 collaborates with an end stop produced on the body of the façade 24 to allow the actuating press rod 12 to catch on the body when the control button 20 is depressed into its actuated position and thus keep the actuating press rod 12 and the control button 20 in their actuated position. Moreover, the actuating press rod also comprises an actuating tab 123 situated at the periphery, in a parallel plane lower than the planes containing the tripping device 120 and the catching device 121. The actuating tab 123 is actuated in an actuating plane situated in an axial plane of the button.

The emergency stop device comprises means for unlocking the control button which are operated for example by turning the control button 20 about the control axis (X). As the control button 20 is turned, it turns the actuating press rod 12. The turning of the actuating press rod 12 releases the catching device 121 from its end stop and, under the action of the return spring R1, allows the control button 20, and therefore the actuating press rod 12, to return to their rest position.

Advantageously, the emergency stop device may also comprise a lighting assembly assembled with the printed circuit 23 and intended to perform an indicating light function of the emergency stop device. This lighting assembly comprises, for example, a number of light emitting diodes. The lighting assembly is, for example, controlled in such a way as to light up the emergency stop device in green or in red according to the operational status of that device. Light guides may be provided to allow light from the lighting assembly to pass toward a transparent ring 18 provided under the control button.

Moreover, to stiffen the structure of the device and guide the translational movement of the control button 20, a device may be provided for guiding the elements of the device. This guiding device is made up of a rod 210, for example a metal rod, having a first end fixed to the closed end of the casing 21, said rod extending, along the control axis (X), through the printed circuit 23, the central drilling of the actuating press rod 12 and the opening spring R2, and having a second end that becomes lodged in a housing produced in the control button 20.

According to the invention, the device also comprises a set of electrical contacts made up of a mobile electrical contact 70 and of a fixed electrical contact 71 produced on a surface of the printed circuit 23, preferably on the underside surface thereof. The mobile electrical contact 70 is carried by a flexible strip 6 situated under the printed circuit and having a first end fixed to the printed circuit 23, preferably to the underside surface thereof, and a free second end near which the mobile electrical contact 70 is situated. The flexible strip 6 can adopt a first rest position in which the contacts are closed, and an actuated position in which the contacts are open.

The flexible strip 6 is designed to collaborate with the actuating press rod 12 in order to control the electrical circuit. According to the invention, the flexible strip 6 is configured in such a way as to form a rigid area against which the actuating tab 123 of the actuating press rod can bear.

Figure 9:
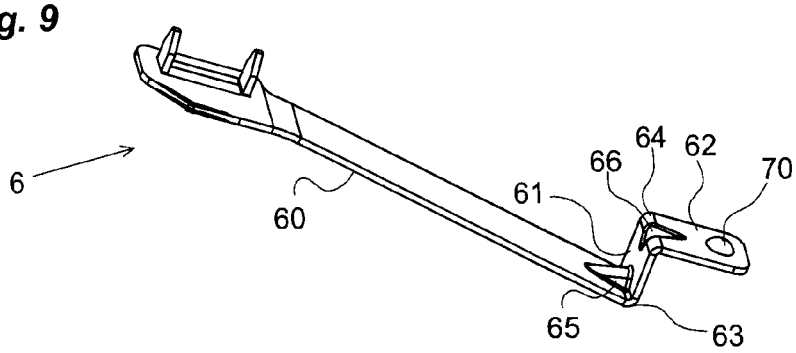
FIG. 9 depicts, in perspective, the flexible strip used in the device of the invention.

More specifically, as depicted in FIG. 9, the flexible strip 6 comprises a first portion 60 fixed by the first end to the printed circuit 23, extended by a second portion 61 and then by a third portion 62. On the flexible strip 6, the first portion 60 and the second portion 61 are joined together by a first bend 63 and the second portion 61 and the third portion 62 are joined together by a second bend 64. The third portion 62 carries the mobile electrical contact 70, situated facing the fixed electrical contact 71. On each bend 63, 64, the flexible strip 6 has at least one rib 65, 66 produced by stamping. According to the invention, the three portions 60, 61, 62 are produced straight. When the flexible strip is in the rest position, the second portion 61 of the flexible strip 6 is produced in a plane situated in the actuating plane defined hereinabove. Thus, the movement force generated by the actuating tab 123 is applied to the flexible strip 6 in the actuating plane, preventing the flexible strip from flexing in the bearing area. The ribs 65, 66 are produced on the inside of the bend. The presence of the two bends and the addition of the ribs stiffens the flexible strip in the area against which the actuating tab 123 bears. Thanks to this arrangement and to the straight shape of the first portion 60, the flexible strip 6 can withstand significant mechanical force without flexing in its bearing area, thus allowing the electrical contacts to be separated if they have become welded together.

Moreover, the device also comprises a contact pressure spring R5 assembled between the flexible strip 6 and the casing 21 and situated under the third part 62 of the flexible strip 6. It is intended to provide the contact pressure that presses the mobile electrical contact against the fixed electrical contact when the contacts are closed. When the actuating press rod is in the actuated position it is made to press on the flexible strip 6 and to compress this spring R5.

For preference, the device may comprise two sets of contacts of the normally closed type and therefore two flexible strips and two contact pressure springs.

The invention claimed is:

1. An emergency stop device comprising:

a body;

a control button movable in translation along a control axis;

at least one set of electrical contacts of normally closed type including a mobile electrical contact and a fixed electrical contact;

a flexible strip including a fixed first end and a free second end and an actuating press rod configured to be actuated in translation by the control button between a rest position and an actuated position and configured to collaborate with the flexible strip, the actuating press rod including an actuating tab configured to apply a movement force to the flexible strip, the force being applied along the control axis;

wherein the flexible strip comprises:

a first portion connected to the fixed first end, a second portion connected to the first portion and disposed in a plane that is parallel to the control axis, and a third portion connected to the second portion and to carry the mobile electrical contact.

2. The device as claimed in claim 1, wherein:

the first portion is connected to the second portion by a first bend, the second portion is connected to the third portion by a second bend, the flexible strip includes a rib made on the first bend and a rib made on the second bend.

3. The device as claimed in claim 1, wherein the first portion, the second portion, and the third portion are produced straight.

4. The device as claimed in claim 1, further comprising a contact pressure spring positioned between the flexible strip and the body.

5. The device as claimed in claim 1, further comprising a printed circuit on which the fixed electrical contact is disposed.

6. The device as claimed in claim 5, further comprising a tripping device collaborating with the actuating press rod and with the body and including a position of abutment in which the tripping device keeps the actuating press rod in the rest position and an actuated position in which the tripping device releases the actuating press rod under an action of the opening spring.

7. The device as claimed in claim 6, wherein the tripping device is configured to move in a plane perpendicular to the control axis.

8. The device as claimed in claim 6, further comprising a catching device collaborating with the actuating press rod and with the body and including a position of actuation in which the catching device keeps the actuating press rod in the actuated position and releases the actuating press rod under a rotation action of the control button.

9. The device as claimed in claim 8, wherein a plane of translation of the tripping device is situated above a plane of translation of the catching device.

10. The device as claimed in claim 5, further comprising a lighting assembly assembled with the printed circuit.

11. The device as claimed in claim 5, further comprising a guide rod oriented along the control axis and passing through the printed circuit and an actuating device and that becomes inserted in an axial housing of the control button.

12. The device as claimed in claim 1, further comprising an opening spring arranged between the control button and the actuating press rod.

13. The device as claimed in claim 1, wherein the control button is configured to move between two extreme positions of a rest position and an actuated position in which the control button comes to rest against a fixed end stop of the body.

14. The device as claimed in claim 1, wherein the device is included in a human-machine dialog system, the human-machine dialog system further comprising:

a first part including a data processor;

a second part including plural human-machine dialog devices each including a human-machine dialog interface and a fixing support configured to accept each human-machine dialog device in a removable and interchangeable manner;

a communication and power supply circuit arranged between the first part and each human-machine dialog device;

at least one of the plural human-machine dialog devices including the emergency stop device.

* * * * *